US008163993B2

(12) United States Patent
Gordin et al.

(10) Patent No.: US 8,163,993 B2
(45) Date of Patent: Apr. 24, 2012

(54) APPARATUS, METHOD, AND SYSTEM FOR GROUNDING SUPPORT STRUCTURES USING AN INTEGRATED GROUNDING ELECTRODE

(75) Inventors: Myron Gordin, Oskaloosa, IA (US); David L. Barker, Ottumwa, IA (US); Gabriel P. Gromotka, Pella, IA (US); Gregory N. Kubbe, Ottumwa, IA (US)

(73) Assignee: Musco Corporation, Oskaloosa, IA (US)

( * ) Notice: Subject to any disclaimer, the term of this patent is extended or adjusted under 35 U.S.C. 154(b) by 191 days.

(21) Appl. No.: 12/709,991

(22) Filed: Feb. 22, 2010

(65) Prior Publication Data

US 2010/0224385 A1 Sep. 9, 2010

Related U.S. Application Data

(60) Provisional application No. 61/157,017, filed on Mar. 3, 2009.

(51) Int. Cl.
*H01R 4/66* (2006.01)

(52) U.S. Cl. ..... 174/6; 174/7; 174/78; 174/40; 439/98; 248/49

(58) Field of Classification Search ..... 174/6, 3, 174/7, 51, 40 CC, 78; 439/92, 98, 100; 248/49
See application file for complete search history.

(56) References Cited

U.S. PATENT DOCUMENTS

| | | | | |
|---|---|---|---|---|
| 1,437,613 | A * | 12/1922 | Petersen | 174/7 |
| 1,766,587 | A * | 6/1930 | Banner | 403/206 |
| 2,545,048 | A | 3/1951 | Salmons | |
| 4,076,198 | A * | 2/1978 | Garrett | 248/49 |
| 4,192,963 | A * | 3/1980 | Koehmstedt | 174/6 |
| 4,996,636 | A * | 2/1991 | Lovett | 362/431 |
| 5,160,271 | A * | 11/1992 | Franks, Jr. | 439/92 |
| 5,909,005 | A | 6/1999 | Boston | |
| 7,112,742 | B2 * | 9/2006 | Yoshimatsu | 174/51 |
| 7,919,711 | B2 | 4/2011 | Crutcher | |

* cited by examiner

*Primary Examiner* — Dhirubhai R Patel
(74) *Attorney, Agent, or Firm* — McKee, Voorhees & Sease, P.L.C.

(57) ABSTRACT

Disclosed herein are apparatus, methods, and systems for grounding outdoor light poles, as well as other structures, which may be exposed to lightning or other adverse electrical effects and may require a low impedance path to ground. Inventive aspects include a combination of apparatus integral to the pole or other structure and installation considerations whereby the ease of installation, reduction of onsite installation error, and reduction of impedance may be tailored to each installation. An apparatus can include a pre-installed earth grounding electrode at the lower end of the pole or structure to be inserted into the earth. A method can include installing an earth grounding electrode to/on/in a lower end of a pole or structure prior to insertion into the earth.

17 Claims, 13 Drawing Sheets

APPARATUS, METHOD, AND SYSTEM FOR GROUNDING SUPPORT STRUCTURES USING AN INTEGRATED GROUNDING ELECTRODE

CROSS-REFERENCE TO RELATED APPLICATIONS

This application claims priority under 35 U.S.C. §119 to provisional U.S. application Ser. No. 61/157,017, filed Mar. 3, 2009, hereby incorporated by reference in its entirety.

I. BACKGROUND OF THE INVENTION

The present invention generally relates to grounding structures which may experience adverse electrical effects, such as lightning. More specifically, the present invention relates to grounding outdoor support structures, such as light poles, by providing a low impedance path to ground.

It is well known that earth grounding is required for outdoor light poles as well as other structures per the United States National Electric Code (NEC), National Fire Prevention Association (NFPA), and most local codes. The general purpose of earth grounding such structures is to provide a path of low impedance such that electrical discharge from lightning or other sources may be dissipated to the earth with minimal damage to property or person.

Outdoor light poles as well as other structures are generally mounted to a concrete foundation, typically pre-cast or poured in situ, which interrupts the low impedance path to ground. For such structures NEC requires a copper or copper-clad earth grounding electrode of at least 8 feet length to be buried to a minimum depth of 10 feet and connected to the light pole by a conductor sized appropriately per NEC code to complete the low impedance path to ground. If the measured resistance of the installed earth grounding electrode is greater than 25 ohms, then a second earth grounding electrode of at least 8 feet length must be buried to a minimum depth of 10 feet and connected to the light pole by a conductor sized appropriately per NEC code.

Earth ground electrodes are generally provided and installed by the onsite contractor rather than the manufacturer of the outdoor structure or equipment to be installed on the structure. The contractor may not supply earth ground electrodes of the correct size and material, or may not drive the electrodes to the appropriate depth, or for a variety of other reasons, installation of the electrodes may be done incorrectly, or not at all. Improper installation of earth ground electrodes may lead to an insufficient impedance path to ground which may result in property damage.

It is also well known that various soil types demonstrate lower electrical impedance than others, particularly when moisture content is a factor. In certain soil conditions a resistance of 25 ohms can be difficult to achieve, even with appropriate installation of earth grounding electrodes per NEC code. Adding an additional earth ground electrode decreases the impedance path to ground but in cases of very poor soil conditions the overall earth grounding system may still exceed the 25 ohm resistance. Additionally, as has been stated, earth ground electrodes are typically provided by the onsite contractor and are not always installed correctly, so the consistency of the earth grounding system is limited from application to application.

A well known alternative to burying the earth ground electrodes in the soil is to bury the earth ground electrodes in the poured concrete foundation, known typically as an Ufer ground. For such structures NFPA and the Underwriters Laboratories, Inc. (UL) require a structural steel electrode of 20 feet to be buried in the concrete foundation and connected to the light pole or other structure by a conductor sized appropriately per NEC and NFPA code. Using the concrete foundation in this way increases the surface area in contact with the soil thereby decreasing the impedance of the earth ground connection. However, this alternate method of installing earth ground electrodes also relies upon the onsite contractor for consistency and correctness. Thus, there is room for improvement in the art.

II. SUMMARY OF THE INVENTION

The effectiveness of earth grounding electrodes for outdoor light poles as well as other structures which may be exposed to lightning or other adverse electrical effects, and may require a low impedance path to ground, is limited, at least in part, by the soil conductivity and installation factors. While the NEC, NFPA, UL and other entities make provisions to standardize and ensure effective earth ground electrode systems, these provisions continue to rely on the onsite contractor to shoulder the labor and material cost associated with earth grounding, as well as ensure the proper installation. Therefore, it is useful to develop means and methods of earth grounding such that installation error is reduced while a low impedance path to ground is maintained. It is further useful for said means and methods to be integral to the outdoor light pole or other structure such that consistency is maintained from application to application and overall ease of installation is increased.

Apparatus for earth grounding electrodes and methods for connecting earth ground electrodes to outdoor structures are envisioned. Earth ground electrodes herein are envisioned as any form (e.g., rod, wire, braided rope) of a conductive material (e.g., copper-clad aluminum, structural steel, copper) appropriately sized and deemed acceptable by the aforementioned governing codes. One typical application may be large area outdoor sports lighting fixtures secured to galvanized steel light poles that are then mounted to pre-cast concrete bases, however, any structure which may be exposed to lightning or other adverse electrical effects and may require a low impedance path to ground would likewise benefit.

It is therefore a principle object, feature, advantage, or aspect of the present invention to improve over the state of the art and/or address problems, issues, or deficiencies in the art.

Further objects, feature, advantages, or aspects of the present invention may include one or more of the following:

a. an increased ease of installation when compared to current art grounding systems,
b. a reduction of onsite installation error when compared to current art grounding systems,
c. a reduction of impedance when compared to current art grounding practices,
d. at least the minimum required length of electrode per governing codes in situations where this cannot be achieved with current art grounding practices; and
e. flexibility to provide varying levels of reduced impedance while not preventing grounding according to current art practices.

One aspect of the present invention, illustrated by one example in FIG. 8, comprises an earth grounding system whereby an earth ground electrode 30 is wound around a pre-cast concrete base 10, fed through an above-backfill access panel 12 in concrete base 10, and run along a portion of the length of a conductive light pole 20 to where electrode 30 is terminated at a termination point 14. When concrete base 10 is placed to depth in the ground, concrete backfill 40 completely surrounds earth ground electrode 30, increasing the surface area in contact with the soil and thereby acting to further reduce impedance. A low impedance path to ground is completed by the following: an adverse electrical condition (e.g., lightning strike) occurs at conductive pole 20, travels to termination point 14, down electrode 30, into concrete backfill 40, and dissipates into the earth. Winding of earth ground electrode 30 in such a fashion allows the minimum earth ground electrode length to be achieved even if the length of concrete base 10 buried in concrete backfill 40 is less than the required length per the aforementioned governing codes.

Another aspect of the present invention, illustrated by one example in FIGS. 9A and 9B, comprises an earth grounding system whereby a lower earth ground electrode portion 31 (shown as at least two rods to achieve the minimum length per aforementioned governing codes) is attached to concrete base 10. Each rod of lower earth ground electrode 31 is connected to an upper earth ground electrode portion 32 at a connection point 61. Upper earth ground electrode 32 is fed through an above-backfill access panel 12 in concrete base 10, and run along a portion of the length of conductive light pole 20 to where electrode portion 32 is terminated at a termination point 14. When concrete base 10 is placed to depth in the ground, concrete backfill 40 completely surrounds the earth ground electrode 30, increasing the surface area in contact with the soil and further reducing impedance. A low impedance path to ground is completed by the following: an adverse electrical condition (e.g., lightning strike) occurs at conductive pole 20, travels to termination point 14, down electrode portion 32, across connection point 61, down electrode potions 31, into concrete backfill 40, and dissipates into the earth. Connecting lower earth ground electrode portion 31 to concrete base 10 during manufacturing eliminates the need for the contractor to separately drive earth ground electrodes into the ground onsite, but the availability of access panel 12 still allows for a contractor to do so and wire the driven electrodes to termination point 14 or integrate with electrode portion 32, if desired. Connection point(s) 61 may also be completed during manufacturing to further reduce installation error and improve the overall ease of installation.

These and other objects, features, advantages, or aspects of the present invention will become more apparent with reference to the accompanying specification.

III. BRIEF DESCRIPTION OF THE DRAWINGS

From time to time in this description reference will be taken to the drawings which are identified by figure number and are summarized below.

FIG. 1 illustrates a pre-cast concrete base according to aspects of the invention in which the earth ground electrode is wound around the concrete base and fed through the inner diameter to connect with an outdoor light pole or other structure.

FIG. 2 illustrates a pre-cast concrete base according to aspects of the invention in which the earth ground electrode is wound around the concrete base and cast into the wall of the concrete base to connect with an outdoor light pole or other structure FIG. 3 illustrates a pre-cast concrete base according to aspects of the invention in which the earth ground electrode is embedded as a cage in the surface of the concrete base and cast into the wall of the concrete base to connect with an outdoor light pole or other structure.

FIG. 4 illustrates a pre-cast concrete base according to aspects of the invention in which the earth ground electrode is wound within the wall of the concrete base and cast into the wall of the concrete base to connect with an outdoor light pole or other structure.

FIGS. 5A-C illustrate detailed views of one possible design for the optional conductive collar of FIGS. 2 and 3. FIG. 5A illustrates a top view of the collar, FIG. 5B illustrates a side view of the collar, and FIG. 5C shows a side view of the collar when in place on a concrete base.

FIGS. 11A and 11B illustrate the system of FIG. 4 modified to include an optional bolt assembly. FIG. 11B is an enlarged view of Detail A of FIG. 11A.

FIGS. 12A and 12B illustrate the system of FIG. 1 modified to include an optional bolt assembly. FIG. 12B is an enlarged view of Detail A of FIG. 12A.

IV. DETAILED DESCRIPTION OF EXEMPLARY EMBODIMENTS

A. Overview

Figure 1:
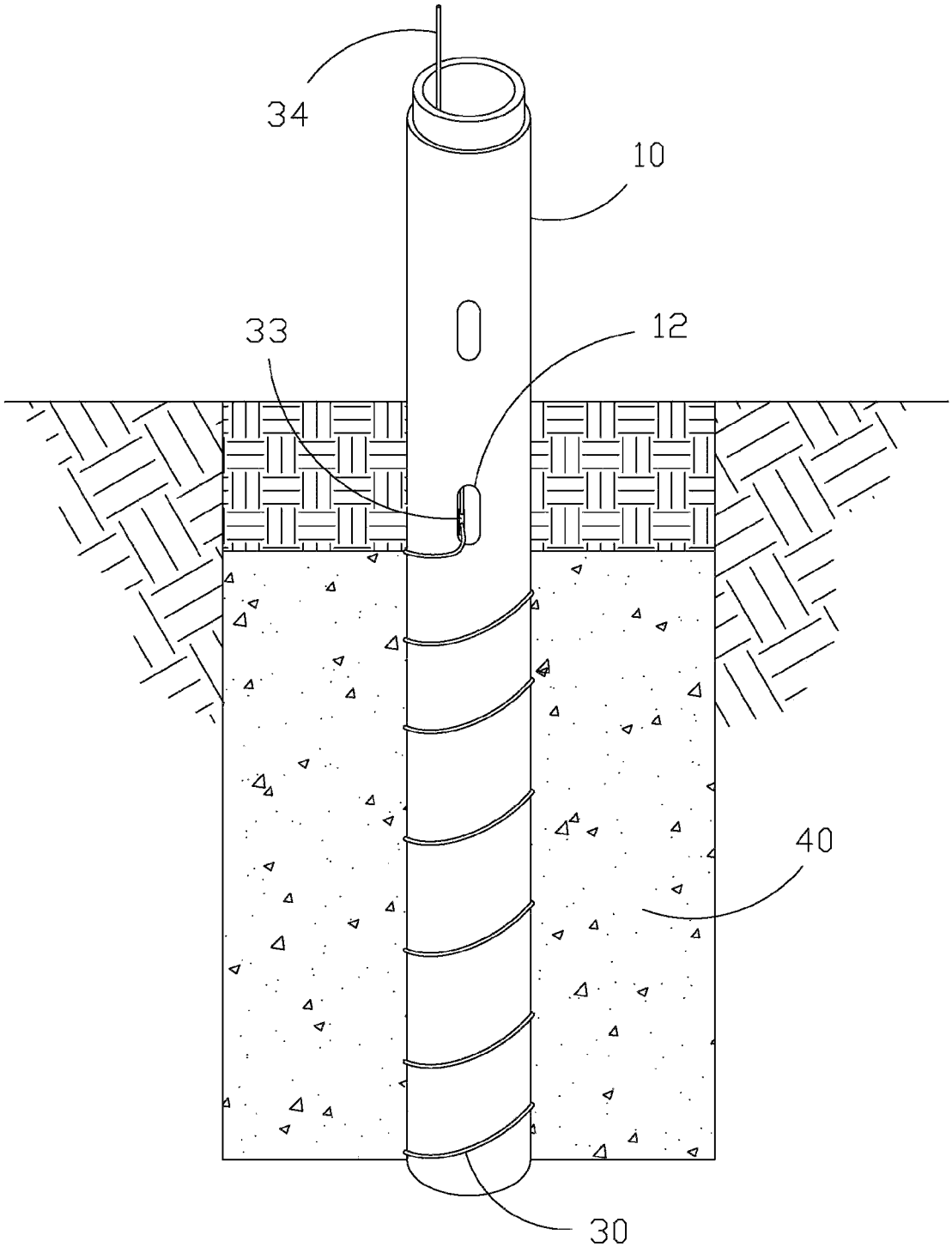

To further understanding of the present invention, specific exemplary embodiments according to the present invention will be described in detail. Frequent mention will be made in this description to the drawings. Reference numbers will be used to indicate certain parts in the drawings. The same reference numbers will be used to indicate the same parts throughout the drawings unless otherwise indicated (for example, 10 to denote the concrete base).

Figure 10:
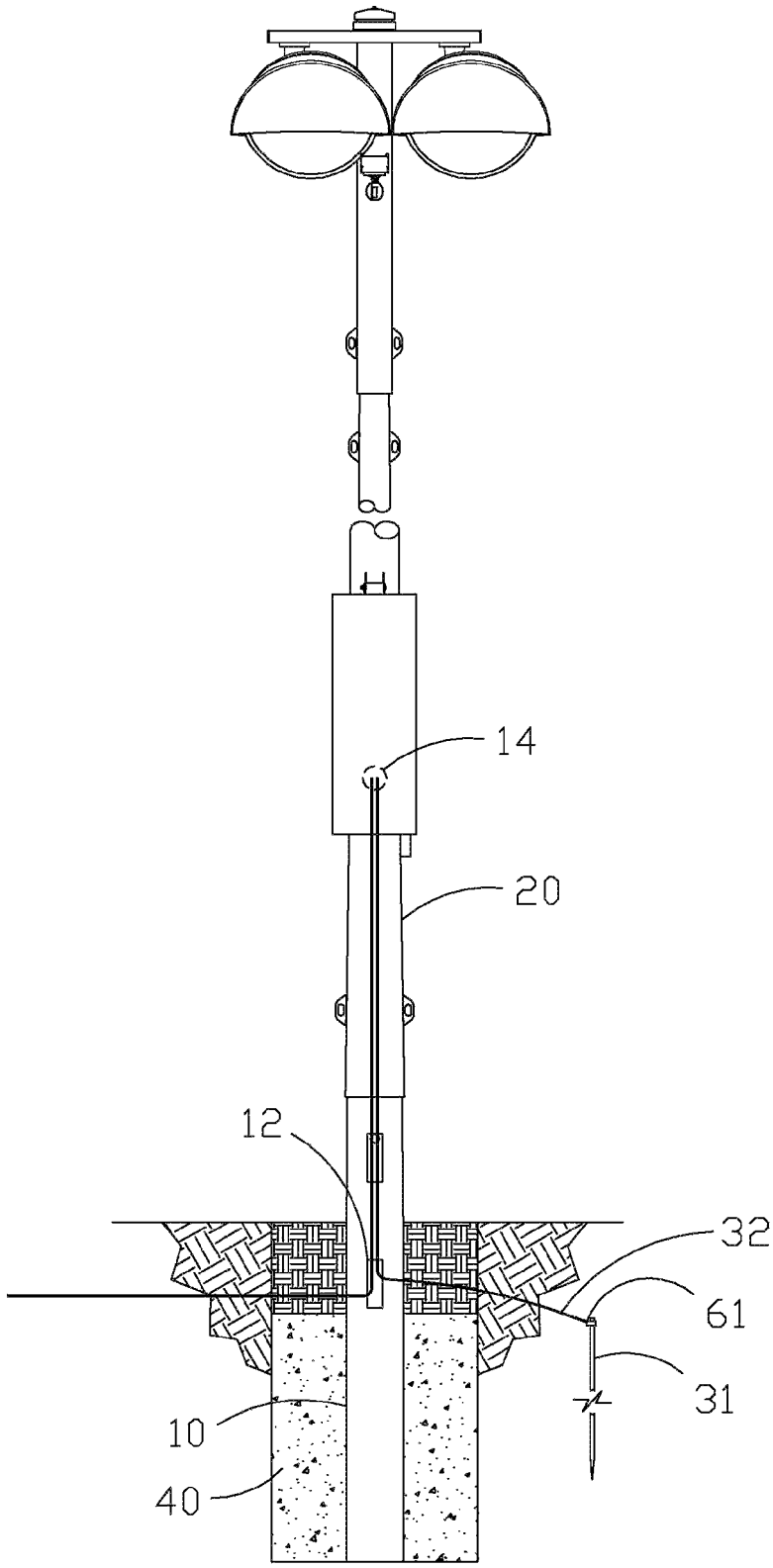
FIG 10 (PRIOR ART)
FIG. 10 illustrates a typical prior art grounding system.

An example of current practice, as shown in FIG. 10, comprises an earth grounding system whereby an earth ground electrode portion 31 is driven directly into the soil. Earth ground electrode portion 31 is connected to an earth ground electrode portion 32 at a connection point 61, is fed through an above-backfill access panel 12 in a concrete base 10, and run along the length of a conductive light pole 20 where electrode portion 32 is terminated at a termination point 14, thus completing the path to ground. If the measured impedance is insufficient per governing codes a second earth ground electrode portion (not shown) must be driven into the soil 180° opposite existing electrode portion 31 and attached to conductive light pole 20 in a fashion similar to existing electrode portion 31.

A related practice is to ground structures according to NEC code using concrete-encased electrodes to produce an earth grounding system known typically as an Ufer ground. This grounding method utilizes the properties of the concrete foundation (e.g., large contact area with the soil, moisture content, mineral properties) to provide an effective electrical bond from the structure to the soil. However, an Ufer ground is generally completed by connecting the earth ground to steel rebar in the concrete foundation and as current practices for foundation design for outdoor light poles and other structures generally do not include such rebar, the Ufer ground may not be readily achieved.

In accordance with aspects of the present invention, exemplary embodiments include a combination of apparatus and installation considerations whereby the ease of installation, reduction of onsite installation error, and reduction of impedance may be tailored for each installation. As described in the exemplary embodiments herein, the apparatus comprises an outdoor structure some part of which may be conductive, some form of earth grounding electrode, and means and methods by which the conductive part of the outdoor structure may be connected to the earth grounding electrode to provide a path to ground. However, this is by way of example and not by way of limitation. For example, an indoor structure may benefit from at least some aspects according to the present invention if exposed to adverse electrical effects.

Another aspect according to the present invention is an increase in the ease of installation of the earth grounding system compared to current practices. This is achieved by establishing an earth ground system integral to the light pole or other structure such that the assembly may be installed with little to no further action taken to ensure a path to ground exists per aforementioned governing codes. However, it is of note that the exemplary embodiments as envisioned do not prevent a contractor from also grounding the light pole or other structure in accordance with current art practices.

Another aspect according to the present invention is a reduction in onsite installation error compared to current practices. This is achieved by establishing an earth ground system integral to the light pole or other structure and supplied by the manufacturer such that the contractor or installing party does not need to provide earth grounding electrodes, thereby increasing the consistency of the overall earth grounding system.

Another aspect according to the present invention is a reduced impedance path of the earth grounding system compared to current practices. This is achieved by establishing an earth ground system integral to the light pole or other structure that is then encased in backfilled concrete thus increasing the surface area in contact with the soil and thereby acting to reduce impedance beyond driving earth ground electrodes directly in the soil.

B. Exemplary Method and Apparatus Embodiment 1—FIG. 1

Earth ground electrode portion 30 is wound around precast concrete base 10 and fed through an above-backfill access panel 12 where it terminates at an electrical junction 33; base 10 may be as is described in U.S. Pat. No. 5,398,478, incorporated herein by reference. Earth ground electrode portion 34 is connected to electrode portion 30 at junction 33. Junction 33 may comprise any manner of conductive fastening device (preferably one that is UL listed) and may further comprise a layer of corrosion protection. Earth ground electrode portion 34 runs along the inner diameter of the upper portion of base 10, extends above base 10, and attaches to the light pole (not shown).

The path to ground is completed by the following: connection made at the light pole (not shown), along earth ground electrode portion 34, across junction 33, along earth ground electrode portion 30, and dissipated into backfilled concrete 40. Alternatively, electrode portion 30 and electrode portion 34 may exist as a single, continuous electrode such that electrical junction 33 is not necessary. In this alternative, the path to ground is completed by the following: connection made at the light pole (not shown), along earth ground electrode 34/30, and dissipated into backfilled concrete 40. It is of note, however, that there are benefits from having two electrode portions versus one long electrode (e.g., reduced cost, convenient point for strain relief).

As illustrated (see also U.S. Pat. No. 5,398,478), concrete base 10 is first lowered into an excavated pit in the ground. The lighting pole may already be attached (e.g., by slip-fitting over the top end of base 10), or may be mounted to the top of base 10 later. Base 10 is plumbed and concrete backfill 40 poured around it. Electrode portion 30 is thus encased in backfilled concrete 40. Concrete backfill 40 or other filler (e.g., soil) may fill the excavated pit above access panel 12.

Figure 12A:
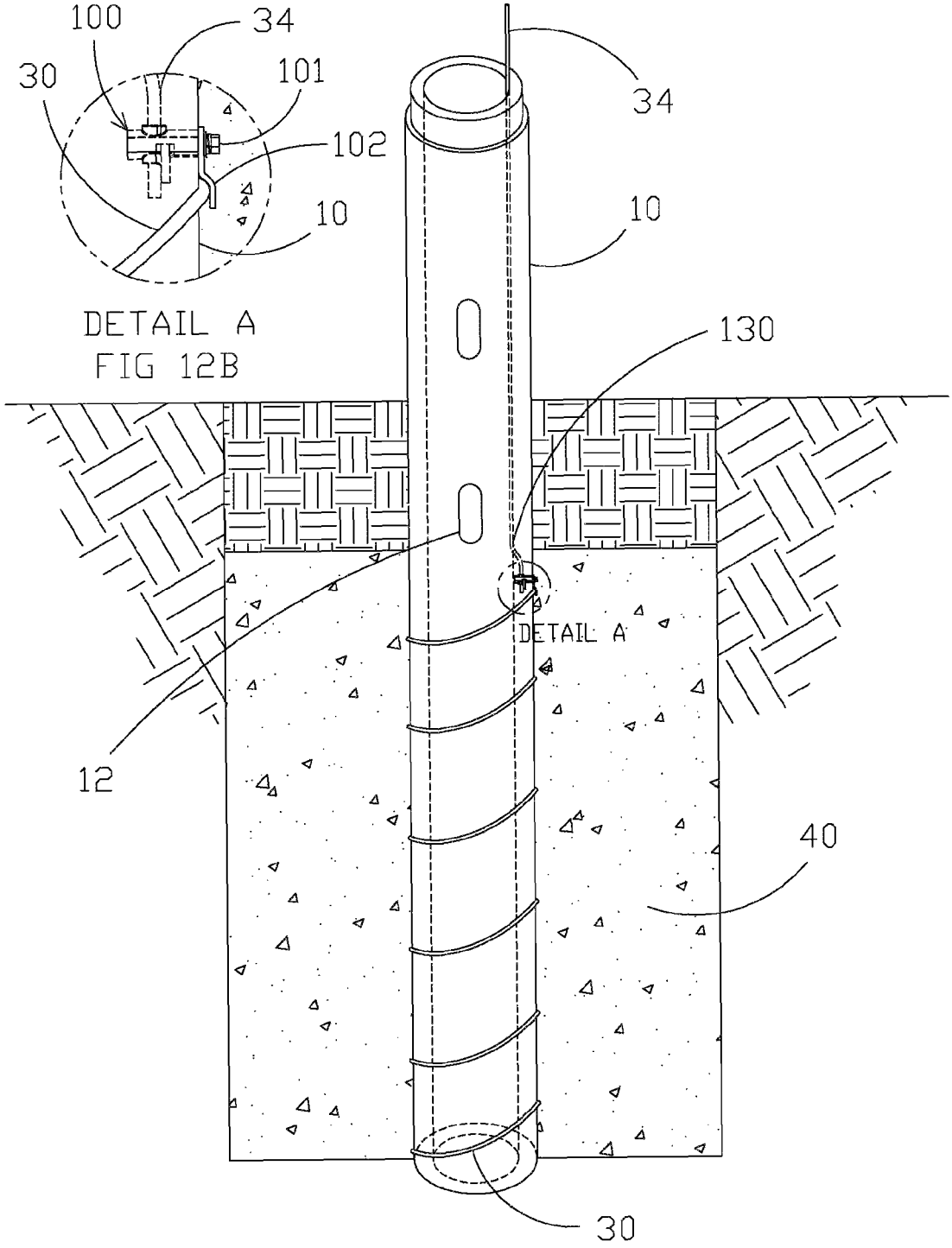

One possible embodiment for junction 33 is illustrated in FIGS. 12A and B. As can be seen from FIGS. 12A and B, electrode portion 30 is wound around concrete base 10 and terminated at a conductive bolt assembly 100 where electrode portion 30 is positionally held by a conductive tab 102. Electrode portion 30 is compressed between tab 102 and concrete base 10 by tightening bolt 101. Electrode portion 34 runs along the inner diameter of concrete base 10 and then enters into the thickness of concrete base 10 at point 130, which may be completed prior to shipping or in-situ via access panel 12. Electrode potion 34 is then secured in bolt assembly 100 and positionally held via tightening of bolt 101. Thus, in this example, bolt assembly 100 acts as electrical junction 33; other embodiments of junction 33 are possible, and envisioned.

C. Exemplary Method and Apparatus Embodiment 2—FIG. 2

Earth ground electrode portion 30 is wound around precast concrete base 10 and fed through the thickness of concrete base 10 at a connection point 35. Earth ground electrode portion 36 is connected to earth ground electrode portion 30 via connection point 35. Connection point 35 may comprise any means and methods of bonding two conductive materials (e.g., weld joint) and may further comprise a corrosion protection layer; alternatively, connection point may utilize an apparatus for joining two conductive materials such as bolt assembly 100 illustrated in FIGS. 12A and B. Earth ground electrode portion 36 is cast inside the wall of concrete base 10 and runs the remaining length of base 10 where it terminates at a conductive collar 50 which is in direct contact with a conductive light pole 20. Electrode portion 30 and lower part of base 10 is then encased in backfilled concrete 40. As illustrated, the outside diameter of collar 50 may be flush with the outside diameter of the adjacent part of base 10 to allow the bottom open end of pole 20 to slip over both collar 50 and base 10. As shown in FIG. 1, this may be enabled by a reduced diameter at the top end of base 10.

The path to ground is completed by the following: light pole 20, across conductive collar 50, along earth ground electrode portion 36, across connection point 35, along earth ground electrode portion 30, and dissipated into the backfilled concrete 40. Alternatively, electrode portion 36 may be operatively connected to collar 50, and continue on to an electrical termination point on light pole 20 (not shown). In this alternative, the path to ground is completed by the following: connection made at light pole 20 (not shown), along earth ground electrode portion 36, across conductive collar 50, along earth ground electrode portion 36, across connection point 35, along earth ground electrode portion 30, and dissipated into backfilled concrete 40.

As a further alternative, earth grounding electrode portion 36 may continue to an electrical termination point on light pole 20 (not shown) without conductive collar 50, similar to Exemplary Method and Apparatus Embodiment 1. In this alternative, the path to ground is completed by the following: connection made at light pole 20 (not shown), along earth ground electrode portion 36, across connection point 35, along earth ground electrode portion 30, and dissipated into backfilled concrete 40.

Figure 5A:
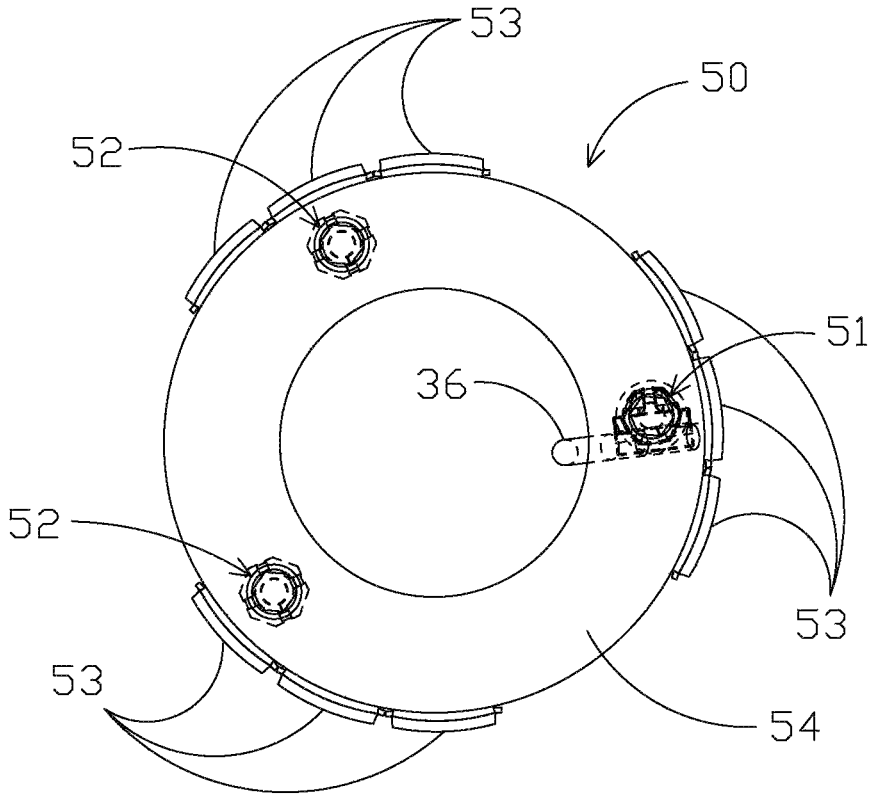
Figure 5B:
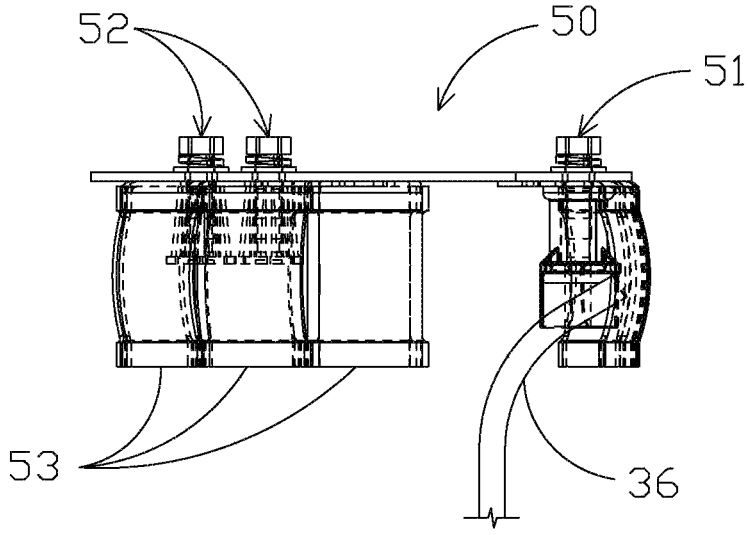
Figure 5C:
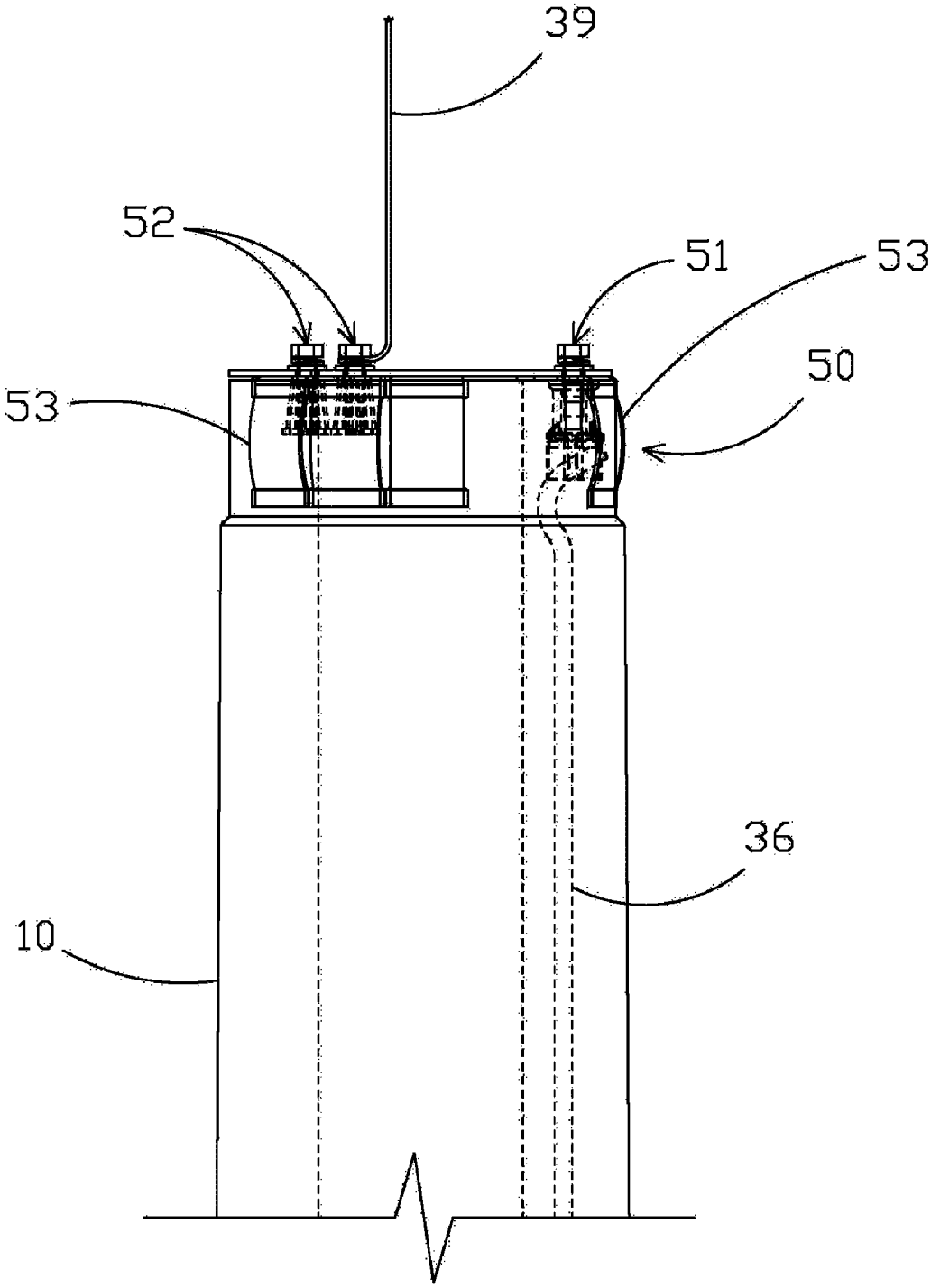

One possible example of collar 50 is illustrated in FIGS. 5A-C. As can be seen from FIGS. 5A-C, conductive collar 50 comprises a top surface 54 through which three bolt assemblies 51 and 52 pass (though there may be more or less bolts), and spring loaded side flanges 53. Bolt assemblies 52 are designed to secure collar 50 to concrete base 10, whereas bolt assembly 51 is designed to both secure collar 50 to base 10 and positionally secure electrode portion 36 (e.g., in a manner similar to that described for bolt assembly 100). FIG. 5C illustrates how complementary holes in collar 50 and base 10, along with the reduced diameter of the top of base 10, allows conductive collar 50 to be affixed to the top of concrete base 10.

Figure 2:
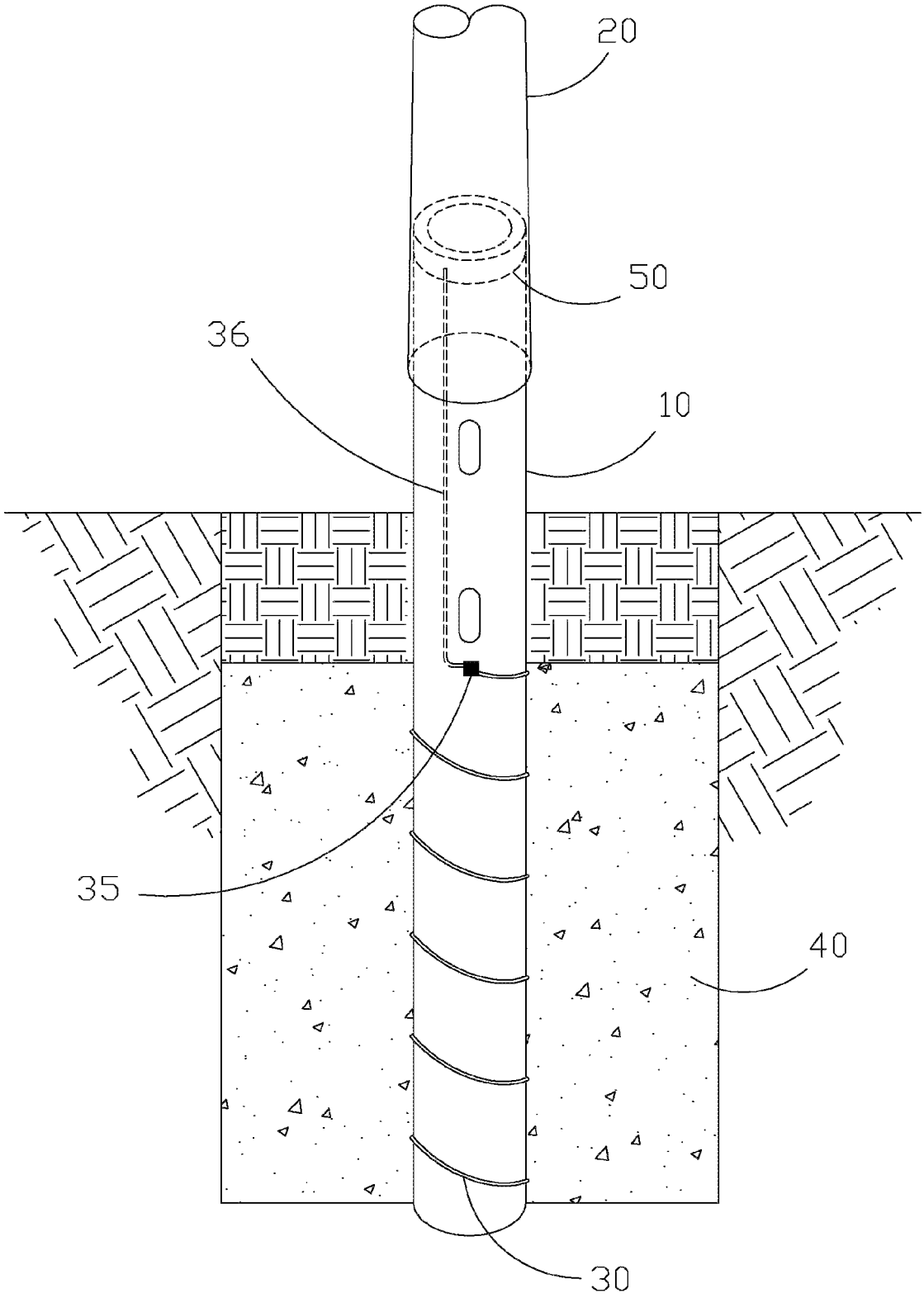

As has been stated, as an alternative to the design illustrated in FIG. 2, electrode portion 36 may extend through collar 50 to an electrical termination point on light pole 20. This is also illustrated in FIG. 5C; as can be seen, electrode portion 36 terminates at bolt assembly 51 and an electrode portion 39, which is secured to bolt assembly 52, continues to an electrical termination point on light pole 20 (not shown). In this alternative, the path to ground is completed by the following: connection made at light pole 20 (not shown), along earth ground electrode portion 39, across conductive collar 50, along earth ground electrode portion 36, across connection point 35, along earth ground electrode portion 30, and dissipated into backfilled concrete 40. Other designs of conductive collar 50 are possible, and envisioned.

Figure 3:
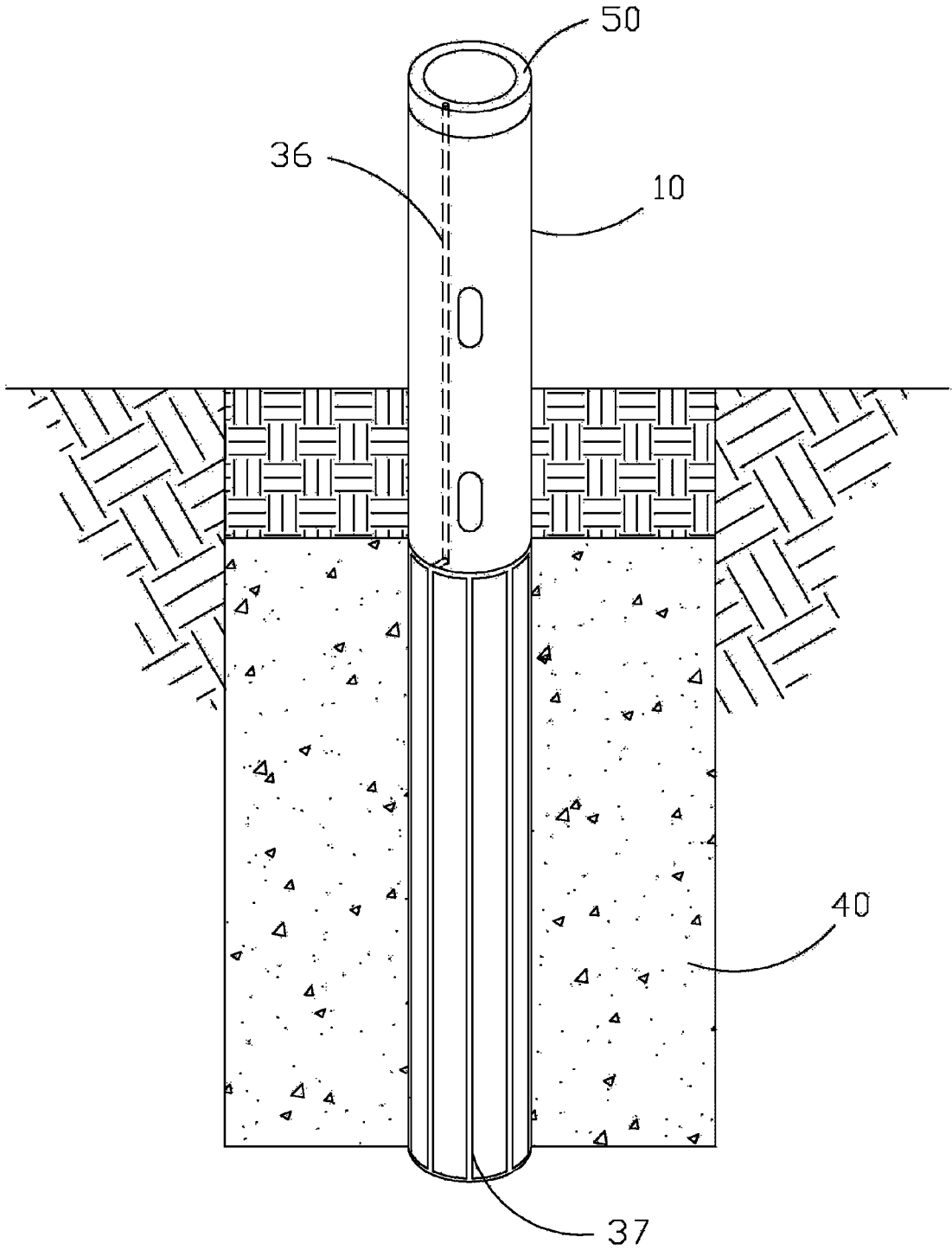

D. Exemplary Method and Apparatus Embodiment 3—FIG. 3

An earth ground electrode portion 37 comprises a conductive cage embedded in the surface of pre-cast concrete base 10. Conductive cage 37 is in contact with earth ground electrode portion 36 which is cast inside the wall of concrete base 10. Earth ground electrode portion 36 runs the length of the upper portion of base 10 where it terminates at conductive collar 50 which is in direct contact with the conductive light pole (not shown). Electrode cage portion 37 is then encased in backfilled concrete 40.

The path to ground is completed by the following: the light pole (not shown), across conductive collar 50, along earth ground electrode portion 36, along earth ground electrode cage portion 37, and dissipated into the backfilled concrete 40.

Alternatively, earth grounding electrode portion 36 may continue through collar 50 to an electrical termination point on the conductive light pole (not shown) similar to Exemplary Method and Apparatus Embodiment 2. As a further alternative, the earth grounding electrode portion 36 may continue to an electrical termination point on the conductive light pole (not shown) without conductive collar 50, similar to Exemplary Method and Apparatus Embodiment 1.

As a further alternative, earth grounding electrode cage portion 37 may be a component separate from pre-cast concrete base 10 which may be installed onsite and the connection made to earth ground electrode portion 36 similar to connection point 35 as described in Exemplary Method and Apparatus Embodiment 2. In this alternative, the path to ground is completed by the following: the light pole (not shown), across the conductive collar 50, along earth ground electrode portion 36, across connection point 35, along earth ground electrode cage portion 37, and dissipated into the backfilled concrete 40.

Figure 4:
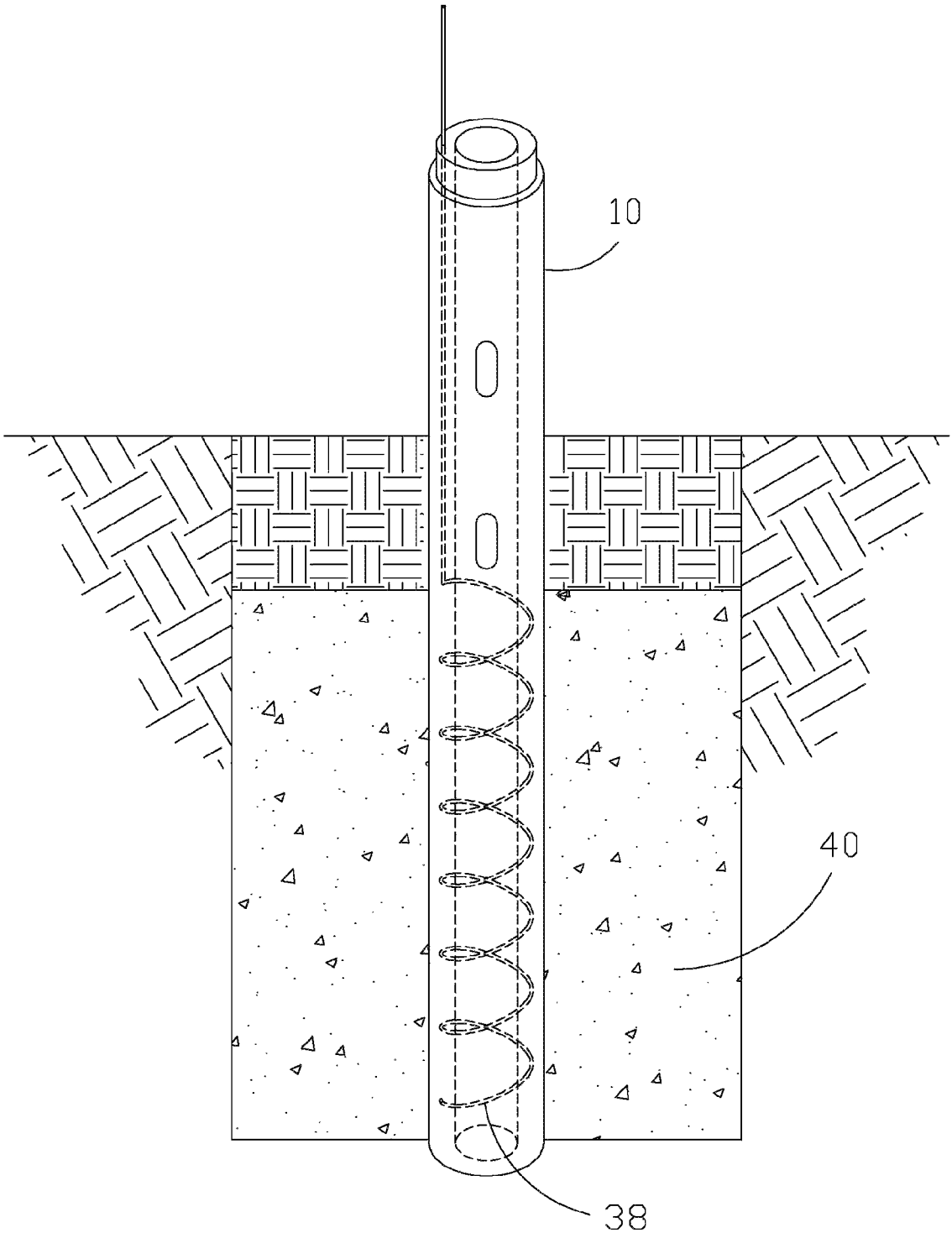

E. Exemplary Method and Apparatus Embodiment 4—FIG. 4

The coil-shaped lower portion and straight portion of earth ground electrode 38 is cast inside the wall of pre-cast concrete base 10, and fed through the thickness of base 10 as a continuous electrode. The straight portion of earth ground electrode 38 extends above concrete base 10, and attaches to an electrical termination point on the conductive light pole (not shown). The lower part of concrete base 10 (and thereby the coil-shaped portion of electrode 38) is then encased in backfilled concrete 40.

The path to ground is completed by the following: connection made at the light pole (not shown), along earth ground electrode 38, through the thickness of the base 10, and dissipated into backfilled concrete 40.

Figure 11A:
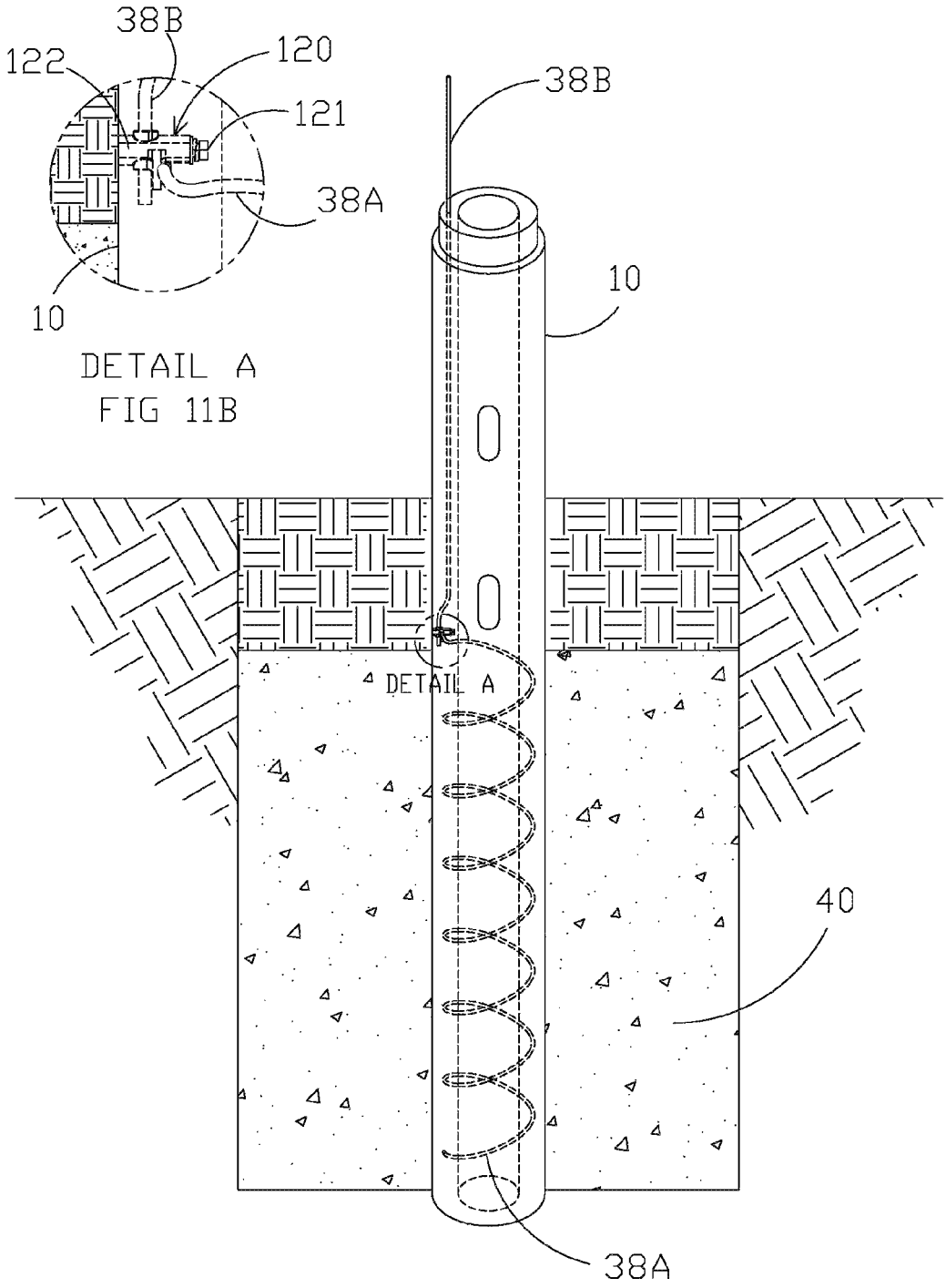

Alternatively, electrode 38 may be broken down into a coiled portion 38A and a straight portion 38B for purposes of strain relief, ease of construction, reduced cost, or otherwise. FIGS. 11A and B illustrate this alternative; as can be seen, a bolt assembly 120, similar to that described in Exemplary Method and Apparatus Embodiment 1, secures electrode portion 38A and electrode portion 38B by tightening bolt 121. Shaft portion 122 of bolt assembly 120 may be plugged or otherwise open at the side surface of concrete base 10 (i.e., where shaft portion 122 is flush with the outer diameter of base 10). This allows additional electrodes to be connected to bolt assembly 120, if desired. A similar bolt assembly may be available at the bottom of electrode portion 38 with shaft portion 122 open on the bottom surface of concrete base 10 (i.e., the surface embedded in concrete 40 and opposite the surface from which electrode portion 38B protrudes). This allows additional electrodes or even conductive collar 50 to be connected to bolt assembly 120.

Figure 6:
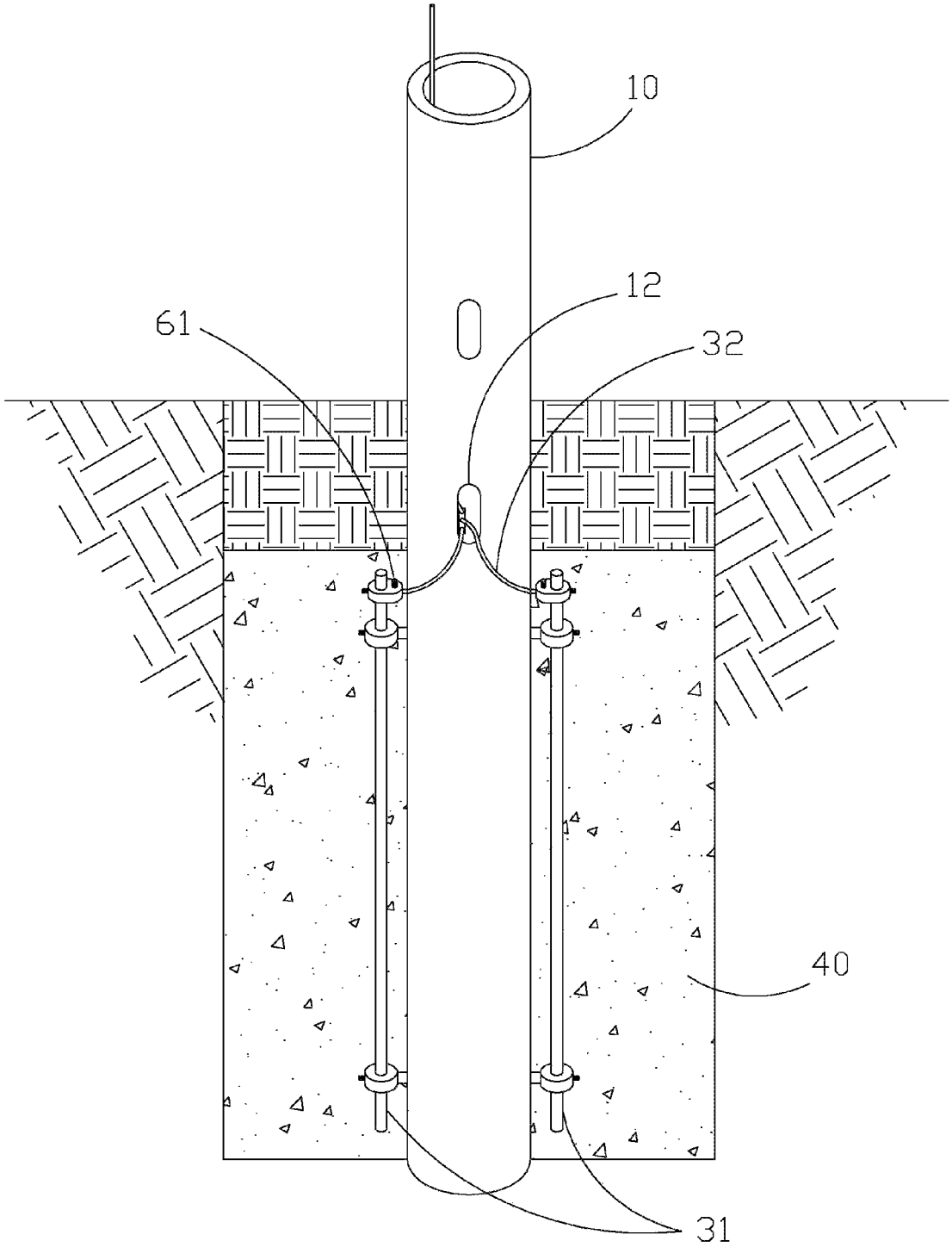
FIG. 6 illustrates a pre-cast concrete base according to aspects of the invention in which the earth ground electrode is first connected to the concrete base and is then fed through the inner diameter of the concrete base to connect with an outdoor light pole or other structure.

F. Exemplary Method and Apparatus Embodiment 5—FIG. 6

Earth ground electrode portion 31 (shown as two rods to achieve the minimum length per aforementioned governing codes) is attached to concrete base 10 by any means or methods described herein or otherwise acceptable by governing codes. Earth ground electrode portion 31 is connected to earth ground electrode portion 32 at a connection point 61. Connection point 61 may utilize any means or methods of connecting conductive materials described herein or otherwise acceptable by governing codes and may consist of a corrosion protection layer. Earth ground electrode portion 32 is fed through an above-backfill access panel 12 in concrete base 10, runs along the inner diameter of base 10, extends above base 10, and attaches to an electrical termination point on the conductive light pole (not shown).

The path to ground is completed by the following: connection made at the light pole (not shown), along electrode portion 32, across connection point 61, along electrode portions 31, and dissipated into backfilled concrete 40.

Alternatively, electrode portion 31 may be one rod or three (or more rods). As a further alternative, bolt assembly 100 (e.g., FIG. 12B) may be utilized (e.g., to provide strain relief for electrode portion 32).

Figure 7:
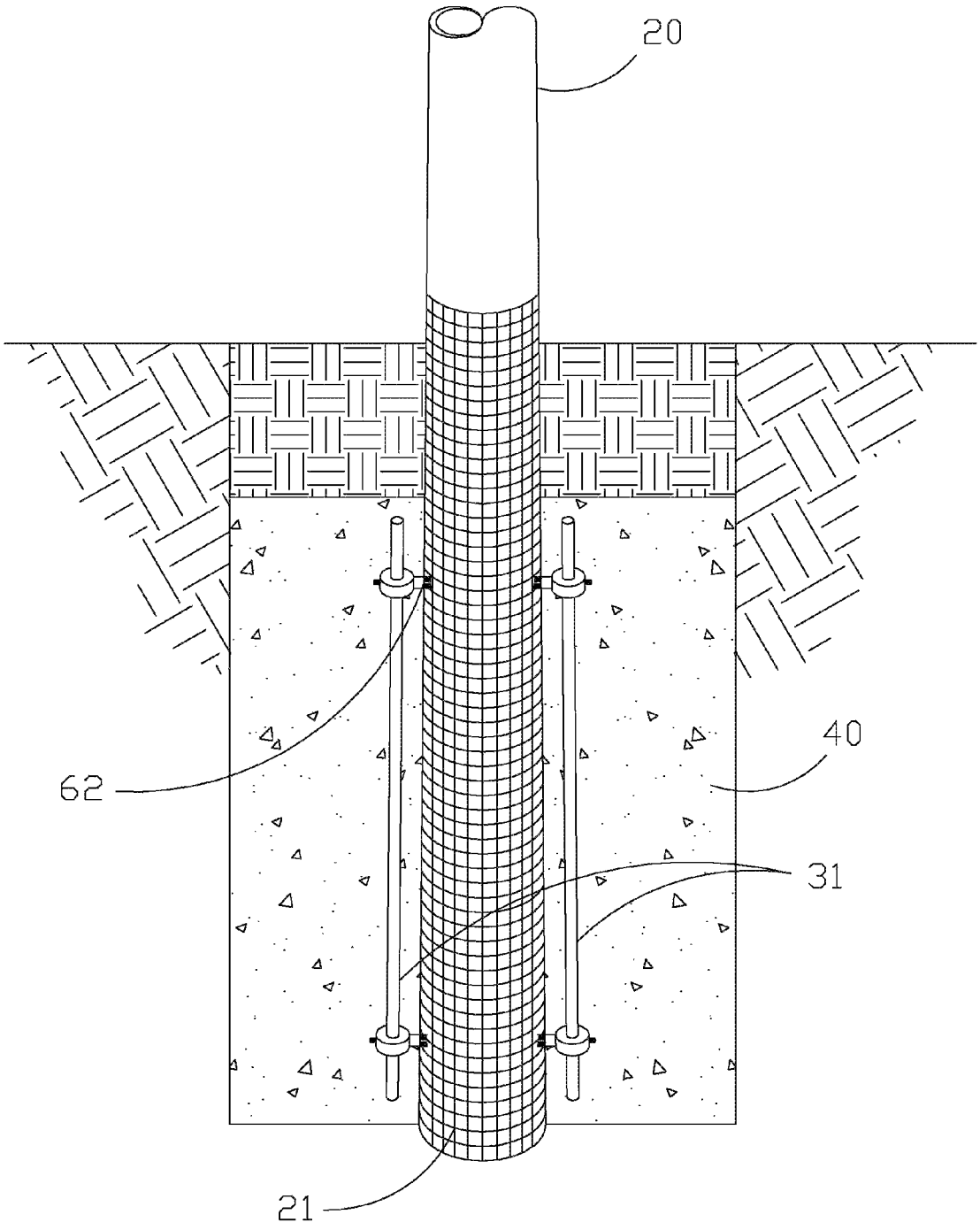
FIG. 7 illustrates a conductive light pole according to aspects of the invention in which the earth ground electrode is attached to the light pole and directly embedded into the poured concrete foundation.
Figure 8:
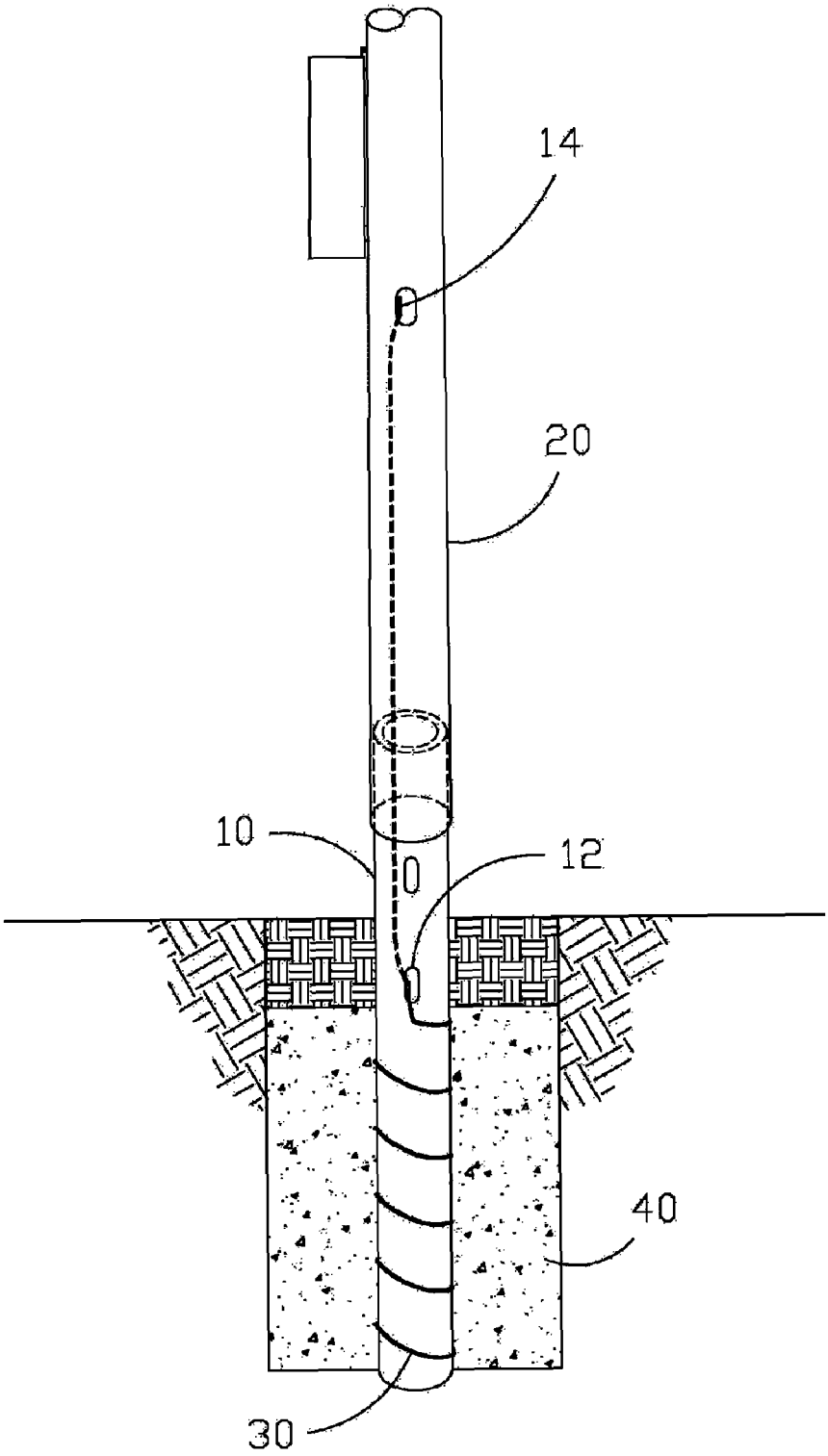
FIG. 8 illustrates the system of FIG. 1 in connection with a typical outdoor light pole.
Figure 9A:
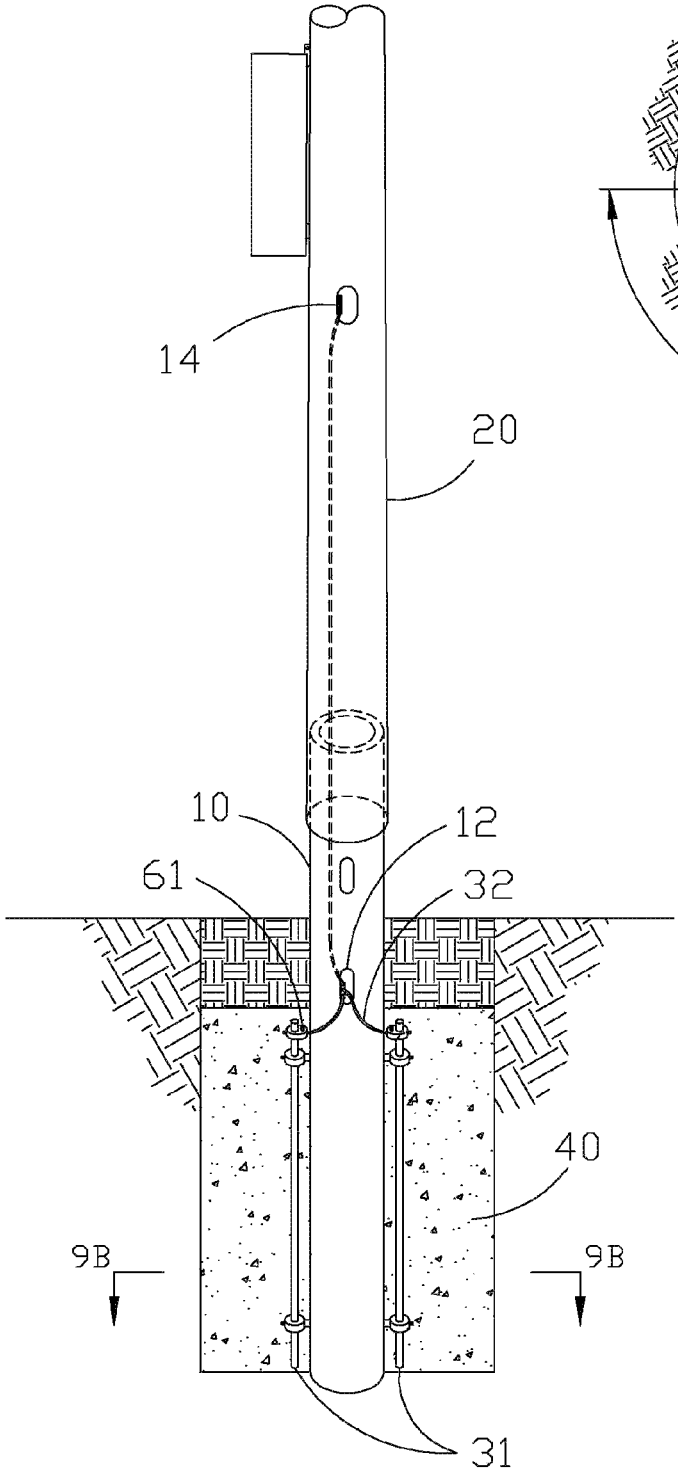
FIG. 9A illustrates the system of FIG. 6 in connection with a typical outdoor light pole.
Figure 9B:
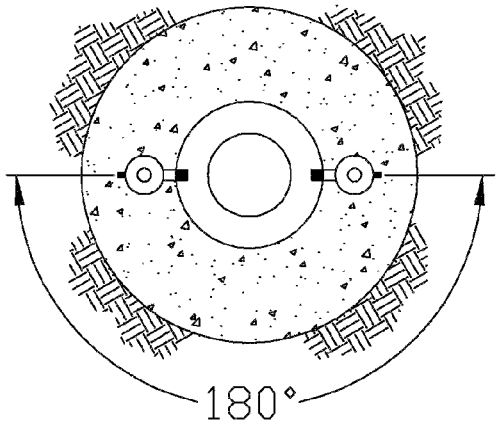
FIG. 9B illustrates a sectional view of FIG. 9A along line 9B-9B.

G. Exemplary Method and Apparatus Embodiment 6—FIG. 7

Earth ground electrode portion 31 (shown as two rods to achieve the minimum length per aforementioned governing codes) is attached to conductive light pole 20 at connection point(s) 62 by any means described herein or otherwise acceptable by governing codes. The embedded portion of the light pole 20 may consist of a non-conductive corrosion protection layer 21 such as are commercially available (e.g. a coating or paint or the like). When pole 20 is placed to depth in the ground, concrete backfill 40 completely surrounds earth ground electrode portion 31, increasing the surface area in contact with the soil and thereby acting to further reduce impedance.

The path to ground is completed by the following: light pole 20, across connection point(s) 62, along earth ground electrode portion 31, and dissipated into backfilled concrete 40.

Alternatively, conductive light pole 20 with corrosion protection layer 21 may use any other form of earth ground electrode described herein. For example, cage 37 described in Exemplary Method and Apparatus Embodiment 3 may be embedded in pole 20, an electrode portion operatively connected to cage 37, said electrode portion run along the length of pole 20 (along the inner diameter or along the outer diameter), and terminated at a point on pole 20 (not illustrated). However, with any embodiment which uses some form of earth ground electrode in direct contact with pole 20, appropriate provisions (e.g., chemical treatment of pole 20) should be made to avoid galvanic corrosion.

H. Options and Alternatives

As mentioned, the invention may take many forms and embodiments. The foregoing examples are but a few of those. To give some sense of some options and alternatives, a few additional examples are given below.

As mentioned, exemplary embodiments make use of an apparatus where the apparatus comprises an outdoor structure some part of which may be conductive, some form of earth grounding electrode, and means and methods by which the conductive part of the outdoor structure may be connected to the earth grounding electrode. The means and methods by which the conductive part of the outdoor structure (typically the light pole itself) may be connected to the earth grounding electrode (various embodiments of which are shown in FIGS. 1-12B) may vary from those described herein and not depart from at least some aspect(s) of the present invention. Further, the design of the earth ground electrode may vary from those described herein. For example, the earth ground electrodes may be wound tighter or in a different fashion than as illustrated herein. Still further, the outdoor structure may vary from the conductive lighting pole described herein; for example, the structure may comprise a truss, a tower, a scaffold, or some other structure. It is of note, however, that if the outdoor light pole or other structure is painted or otherwise non-conductive and lightning strikes the top of the structure, the low impedance path to ground (as envisioned via inventive aspects described herein) is interrupted. In such structures a series of air terminals or similar provisions may be installed such that a lightning strike at the top of the structure would travel along the air terminal or similar provision to a termination point (e.g., see reference no. 14), and continue along any of the aforementioned paths to ground.

The use of conductive collar 50 and bolt assemblies 100/120 may vary according to the needs of a particular application without departing from at least some aspect(s) of the present invention. For example, as described in Exemplary Method and Apparatus Embodiments 1, 4, and 5 the earth ground electrode portion (34, 38, and 32, respectively) ran a substantial part of the length of pre-cast concrete base 10, extended above the base 10, and connected to an electrical termination point on the conductive light pole (not shown). As was described in Exemplary Method and Apparatus Embodiment 2 and Exemplary Method and Apparatus Embodiment 3, earth ground electrode portion 36 ran a substantial part of the length of pre-cast concrete base 10, and terminated at conductive collar 50. Still further, described in Exemplary Method and Apparatus Embodiment 2 and Exemplary Method and Apparatus Embodiment 3 was an option whereby earth ground electrode portion 36 ran the upper length of pre-cast concrete base 10, across the conductive collar 50, extended above the base 10, and connected to an electrical termination point on the conductive light pole (not shown). Any combination of electrode described herein may be combined with conductive collar 50 (if desired) and/or bolt assemblies 100/120 (or analogous components) and, if desired, continued along the conductive pole or other structure to a termination point. Further, placement of collar 50 and bolt assemblies 100/120 may differ from those described herein, provided the low impedance path to ground is not interrupted.

The composition of pre-cast concrete base 10 and backfilled concrete 40 may vary from current systems and practices to include conductive additives (e.g., fly ash, coke, carbon fiber) to further decrease the impedance path to ground for outdoor light poles or other structures installed in adverse soil conditions. It is of note, however, that such conductive additives should not alter the structural integrity of base 10 or backfilled concrete 40 such that the components no longer conform to governing codes. For example, the Universal Building Code requires the concrete used to backfill a pier foundation to have an ultimate compressive strength of 2000 pounds per square inch at 28 days of curing. If a conductive additive was used in backfilled concrete 40 of an embodiment of the invention such that the impedance path to ground was significantly lowered over current systems and practices but the ultimate compressive strength of backfilled concrete 40 at 28 days was lower than what is dictated by the aforementioned governing code, the overall apparatus may no longer be suited to the design criteria of the support structure.

What is claimed is:

1. A method for grounding a structure such as a pole, scaffold, truss, or tower that has a concrete base with a lower end adapted for placement in the earth and an upper end which is adapted for elevation above the surface of the earth and to support the structure, comprising:

a. attaching to, surrounding, or integrating into the concrete base at or towards the lower end of the concrete base an earth grounding electrode, the earth grounding electrode comprising a conductive cage having a plurality of elongated conductive members embedded in the surface of the concrete base;

b. positioning a conductive collar at the upper end of the concrete base apart from the conductive cage and away from the lower end of the concrete base, the conductive collar adapted for electrical connection to a conductive part of or a termination point on the structure; and c. providing an electrical junction between the conductive cage and the conductive collar;

d. so that an earth around path is provided from the conductive part of or termination point on the structure through the conductive collar, electrical junction, and conductive cage.

2. The method of claim 1 further comprising backfilling concrete around conductive cage of the earth grounding electrode when installed in the earth.

3. The method of claim 2 wherein the backfilled concrete comprises a composition having both an effective support of the concrete base and the structure in the earth and effective low impedance path from the electrode to the earth.

4. The method of claim 1 wherein each of the plurality of elongated conductive members comprises one of a rod, wire, or braided rope.

5. The method of claim 4 wherein the conductive cage of the earth grounding electrode is attached, integrated, wrapped, coiled, embedded, encased, or distributed along the lower end of the structure and wherein cumulative length of the plurality of elongated conductive members is greater than the length of the lower end of the structure along which is the conductive cage is positioned.

6. The method of claim 1 wherein electrical connection between the conductive collar and the conductive part of or termination point on the structure is automatic upon assembly of the structure to the concrete base.

7. An apparatus for providing grounding of a structure such as a pole, scaffold, truss, or tower comprising:

a. a concrete base having a lower end adapted for insertion into the earth and an upper end adapted for extending above the surface of the earth and to support the structure;

b. an earth grounding electrode attached, affixed, or integrated to or into the concrete base at or towards the lower end of the concrete base, the earth grounding electrode comprising a conductive cage having a plurality of elongated conductive members embedded in the surface of the concrete base;

c. a conductive collar positioned at the upper end of the concrete base apart from the conductive cage and away from the lower end of the concrete base, the conductive collar adapted for electrical connection to a conductive part of or a termination point on the structure, and d. an electrical junction between the conductive cage and the conductive collar:

e. so that an earth ground path is provided from the conductive part of or termination point on the structure through the conductive collar, electrical junction, and conductive cage.

8. The apparatus of claim 7 wherein each of the plurality of elongated conductive members comprises a rod, a wire, a braided rope, or a multi-branch configuration.

9. The apparatus of claim 8 wherein the conductive cage of the earth grounding electrode is affixed to, wrapped around, placed around, or fully or partially embedded or encased in, the lower end of the concrete base.

10. The apparatus of claim 7 wherein the concrete base is separable from the structure.

11. The apparatus of claim 10 wherein the structure is at least partially conductive.

12. The apparatus of claim 7 further comprising concrete backfill around the conductive cage of the electrode when the concrete base is installed in the earth.

13. The apparatus of claim 12 wherein the backfill concrete has properties that produce an effective low impedance path from the earth grounding electrode to earth and provides a structural support function for the concrete base and the structure.

14. The apparatus of claim 7 wherein the plurality of conductive members of the conductive cage have a total length that is longer than the length of the concrete base along which they are positioned.

15. A system for earth grounding a structure such as a pole, scaffold, truss, or tower that will be supported on a concrete base having a lower end embedded in the earth and an upper end standing above the surface of the earth, comprising:

a. an earth grounding electrode affixed to, embedded in, integrated with, or attached to the concrete base at or towards the lower end of the concrete base, the earth grounding electrode comprising a conductive cage having a plurality of elongated conductive members embedded in the surface of the concrete base:

b. a conductive collar positioned at the upper end of the concrete base apart from the conductive cage and away from the lower end of the concrete base, the conductive collar adapted for electrical connection to a conductive part of or a termination point on the structure;

c. an electrical junction between the conductive cage and the conductive collar;

d. so that an earth ground path is provided from the conductive part of or termination point on the structure through the conductive collar, electrical junction, and conductive cage.

16. The system of claim 15 wherein the earth grounding electrode is affixed to, embedded in, integrated with, or attached to the lower end of the concrete base prior to embedding the lower end of the concrete base in the earth such that placement of the lower end of the concrete base in the earth causes automatic placement of the earth grounding electrode in the earth.

17. The system of claim 15 further comprising a concrete backfill around conductive cage when installed in the earth, the concrete backfill adapted to provide an effective low impedance path from the earth grounding electrode to earth.

* * * * *

UNITED STATES PATENT AND TRADEMARK OFFICE

CERTIFICATE OF CORRECTION

PATENT NO. : 8,163,993 B2
APPLICATION NO. : 12/709991
DATED : April 24, 2012
INVENTOR(S) : Gordin et al.

It is certified that error appears in the above-identified patent and that said Letters Patent is hereby corrected as shown below:

Col. 10, Claim 1d, Line 52:
DELETE after earth "around"
ADD after earth --ground--

Signed and Sealed this
Nineteenth Day of June, 2012

David J. Kappos

David J. Kappos
*Director of the United States Patent and Trademark Office*